United States Patent [19]

Long et al.

[11] Patent Number: 4,624,776

[45] Date of Patent: Nov. 25, 1986

[54] SELECTIVE REMOVAL OF COKE PRECURSORS FROM HYDROCARBON FEEDSTOCK

[75] Inventors: Robert B. Long, Atlantic Highlands, N.J.; Jack Griffel, Sarnia, Canada

[73] Assignee: Exxon Research and Engineering Company, Florham Park, N.J.

[21] Appl. No.: 773,050

[22] Filed: Sep. 6, 1985

Related U.S. Application Data

[63] Continuation-in-part of Ser. No. 587,827, Mar. 9, 1984, abandoned, which is a continuation-in-part of Ser. No. 501,196, Jun. 6, 1983, abandoned.

[51] Int. Cl.[4] ..... C10G 25/00

[52] U.S. Cl. ..... 208/302; 208/309; 208/310 R; 208/91

[58] Field of Search ..... 208/302, 307, 310 R, 208/91, 309

[56] References Cited

U.S. PATENT DOCUMENTS

| | | | |
|---|---|---|---|
| Re. 23,005 | 6/1948 | Lipkin | 208/310 R |
| 2,631,727 | 3/1953 | Cichelli | 208/310 R |
| 2,693,495 | 11/1954 | Hastings et al. | 208/310 R |
| 2,754,344 | 7/1956 | Weatherly | 208/310 R |
| 2,756,157 | 7/1956 | Thorpe | 208/310 R |
| 2,776,250 | 11/1957 | Capell et al. | 208/310 R |
| 4,127,475 | 11/1978 | Farcasiu et al. | 208/310 R |

*Primary Examiner*—William R. Dixon, Jr.
*Assistant Examiner*—Cynthia A. Prezlock
*Attorney, Agent, or Firm*—Henry E. Naylor

[57] ABSTRACT

A major portion, preferably a substantial portion, of the coke precursors may be removed from atmospheric and vacuum resids having a Conradson carbon residue of at least about 10 wt. % by selectively removing the components of said feedstock which have an overall Hildebrand solubility parameter greater than 9.0 and a complexing solubility parameter greater than 1.3, such that there results a coke precursor rich fraction containing components having the requisite solubility parameters and a coke precursor depleted fraction. Each fraction may then be processed separately. Segregation of coke precursors by removing the components having the requisite solubility parameters also results in an enhanced yield of useable liquid hydrocarbons relative to that obtained using conventional separation processes.

11 Claims, No Drawings

SELECTIVE REMOVAL OF COKE PRECURSORS FROM HYDROCARBON FEEDSTOCK

CROSS REFERENCE TO RELATED APPLICATIONS

This is a continuation-in-part application of U.S. Ser. No. 587,827 filed Mar. 9, 1984, and now abandoned which is a continuation-in-part application of U.S. Ser. No. 501,196, filed June 6, 1983, now abandoned.

BACKGROUND OF THE INVENTION

1. Field of the Invention

The present invention relates to the refining of hydrocarbon feedstocks. More particularly, this invention concerns the segregation and removal of coke precursors from atmospheric and vacuum residuum having a Conradson carbon residue of at least about 10 wt.%.

2. Description of Relevant Art

Hydrocarbon feedstocks, whether derived from natural petroleum or synthetic sources, are composed of hydrocarbon and non-hydrocarbon (e.g. heteroatom containing organic molecules) components which differ in boiling point, molecular weight and chemical structure. High boiling, high molecular weight non-hydrocarbons (e.g. asphaltenes) are known to contain a greater proportion of carbon forming constituents (i.e. coke precursors) than lower boiling naphtha and distillate fractions. Because coke precursors form coke during thermal processing (such as is employed in a modern refinery), it is desirable to remove (or at least segregate) the non-hydrocarbon components containing the coke precursors, thereby facilitating further processing of the more valuable fractions of the feedstock. Two methods often utilized to segregate are distillation and solvent deasphalting.

Distillation physically separates a hydrocarbon feedstock into contiguous fractions, each of which is characterized by a specific boiling range and molecular weight. While distillation can effectively reject carbon forming constituents, it has been found that a significant portion of the nonvolatile residue contains valuable hydrocarbons low in coke precursors but too high in molecular weight to distill. Such results are particularly noticeable with heavy hydrocarbon feedstocks such as heavy crudes and oils.

Deasphalting is a solvent extraction process utilizing a light hydrocarbon solvent (e.g., propane, butane or heptane) to separate heavy hydrocarbon feedstocks into a deasphalted oil and a low value residue or asphalt which contains asphaltenes. Unfortunately, the separation is not selective in that much of the more valuable deasphalted oil is precipitated with the residue while hydrocarbons containing coke precursors are extracted with the deasphalted oil.

Thus, both distillation and deasphalting, while upgrading hydrocarbon feedstocks by separation into high and lower boiling fractions, only partially segregate the coke precursors from the more valuable fractions. More importantly, with each process, a significant portion of the more valuable product inherently and unavoidably remains with the coke precursor rich residue. This is particularly so with heavy crudes and oils. Therefore, it would be desirable to have available a simple and convenient method which selectively removes coke precursors from a feedstock and minimizes the loss of more valuable hydrocarbons inherent in conventional separation processes.

Solvent extractions and various other techniques have been proposed for preparation of Fluid Catalytic Cracking (FCC) charge stock from resids. Solvent extraction, in common with propane deasphalting, functions by selection on chemical type, rejecting from the charge stock the aromatic compounds which can crack to yield octane components of cracked naphtha. Low temperature, liquid phase sorption on catalytically inert silica is described by Shuman et al, *Oil and Gas Journal*, Apr. 6, 1953, page 113. U.S. Pat. Nos. 3,565,795 and 3,567,627 describe a method of separating polar materials from petroleum distillate fractions by selective solvent extraction.

U.S. Pat. No. 2,472,723 describes a catalytic cracking process whereby an adsorptive clay is added to the charge to adsorb the polynuclear aromatic compounds which are believed to be coke precursors and thus reduce the amount of coke deposited on the active cracking catalyst. This process suffers, however, in that the adsorptive clay containing the polar molecules is fed through the cracking zone and regenerator of the cracking apparatus and must then be separated from the active cracking catalyst, which has significantly higher catalytic activity than the clay.

SUMMARY OF THE INVENTION

Accordingly, the present invention relates to a process of selectively removing (or segregating) a major portion, preferably a substantial portion, of the coke precursors from atmospheric and vacuum residue feedstock (or fractions thereof). More particularly, it has been discovered that this removal of a major portion of the coke precursors can be accomplished by separating the feedstock into a coke precursor depleted fraction and a coke precursor rich fraction, the latter containing a major portion of those components of the feedstock having a Hildebrand solubility parameter greater than 9.0 and a complexing solubility parameter greater than 1.3. The phase "removal (or segregation) of a substantial portion of the coke precursors" from a hydrocarbon feedstock as used herein refers to removing at least 80%, preferably at least 90%, and most preferably at least 95%, of the coke precursors in said feedstock. As a result of the present invention, there is obtained a coke precursor depleted fraction and a coke precursor rich fraction, with the yield of the coke precursor depleted fraction being greater than that obtained in the absence of the present invention; i.e. by using conventional prior art processes, for an equivalent carbon residue in said coke precursor depleted fraction.

The separation is effected by:

(a) contacting the feedstock with an adsorbent for a period of time sufficient to adsorb a major portion of the coke precursors onto the adsorbent, (b) contacting the adsorbent resulting from step (a) with at least one solvent having an overall Hildebrand solubility parameter from about 8 to about 9 and a complexing solubility parameter of 1.3 or less for a period of time sufficient to desorb a coke precursor depleted fraction, and (c) contacting the adsorbent resulting from step (b) with at least one solvent having an overall Hildebrand solubility parameter from about 10 to about the value where the solvent becomes immiscible with the coke precursor rich fraction and a complexing solubility parameter greater than 1.3 for a period of time sufficient to desorb a coke precursor rich fraction which contains a major portion of the coke precursors present in the feedstock.

DETAILED DESCRIPTION OF THE INVENTION

It is known that a hydrocarbon feedstock can be characterized by the affinity of its components for an adsorbent. In the present invention, a hydrocarbon feedstock is characterized as comprising saturate, aromatic and polar fractions wherein each fraction is defined by its affinity for adsorption on dried Attapulgus clay or neutral alumina. The saturate fraction (or saturates) is that fraction desorbed (or eluted) with cyclohexane and which comprises paraffins, single and multi-ring cycloparaffins and small amounts of single ring aromatics with long side chains. The aromatics fraction (or aromatics) is that fraction desorbed with toluene (following removal of the saturate fraction) and which comprises single ring aromatics, condensed ring aromatics and aromatic sulfur compounds such as thiophenes. The polar fraction (or polars) is that fraction desorbed with a 10% methanol/90% toluene mixture (following removal of the saturate and aromatic fractions) and which comprises primarily molecules containing heteroatoms (including nitrogen and oxygen containing components) as well as a higher concentration of sulfur compounds than in the aromatic fraction.

Hydrocarbon feedstocks are also known to contain components of differing polarity, i.e., an imbalance of electrical charge is associated with said components. The present invention is based on the discovery that a major portion, preferably a substantial portion, of the coke precursors are present in certain components of a hydrocarbon feedstock which have polarity, specifically those components which also have an overall or total Hildebrand solubility parameter greater than 9.0 and a complexing solubility parameter greater than 1.3. Thus, removal of such components effects removal of a major portion, preferably a substantial portion, of the coke precursors from a hydrocarbon feedstock.

As used herein, the components of the feedstock having the requisite solubility parameters will be referred to as the polar or coke precursor rich fraction as defined previously, while the saturate and aromatic fractions (or saturates and aromatics, respectively) will be referred to as the non-polar or coke precursor depleted fraction. However, it should be clearly understood that components having polarity (albeit a different and lower polarity) may also be present in the saturate fraction, the aromatic fraction, or both, but such components are not significant coke precursors.

The overall Hildebrand solubility parameter is a well-known measure of polarity and has been tabulated for numerous compounds (see, for example, Hildebrand, J. H. and Scott, R. L. The Solubility of Non-Electrolytes, Dover Publications, Inc., New York (1964); Barton, A. F. M., "Solubility Parameters", *Chem Reviews,* 75, No. 6 (1975); and Kirk-Othmer, The Eycyclopedia of Chemical Technology, 2nd Ed., Supplement Volume, pp. 889–910, Interscience Publishers, New York (1971), the entire disclosure of each publication being incorporated herein by reference). The complexing solubility parameter is discussed in Kirk-Othmer, supra, described by Dickerson and Wiehe (see C. G. Dickerson and I. A. Wiehe "Spherical Encapsulated Polymer Particles by Spray Drying", Proc. Second Pacific Chemical Engineering Congress, Vol. II, 243 (1977), the entire disclosure of which is incorporated herein by reference) and can be derived readily from the Hildebrand solubility parameter by subdividing the latter into a complexing component and a Van der Waals component. Thus, by proper consideration of both solubility parameters, one can select suitable solvents for desorbing the polar and non-polar fractions from the feedstock.

The present invention is selective in that coke precursors in the hydrocarbon feedstock are separated (or concentrated) into the coke precursor rich (polar) fraction while minimizing the yield loss of valuable non-polars associated with conventional separation processes. Thus, the word "selectivity" as used herein refers to obtaining an enhanced yield of the coke precursor depleted (non-polar) fraction relative to that obtained in the absence of the present separation process for the same level of coke precursors in said non-polar fraction, i.e., the coke precursor depleted fraction will be of higher yield and quality since it contains a reduced amount of coke precursors.

Hydrocarbon feedstocks, which can be treated in accordance with the present invention are heavy atmospheric and vacuum resids having a Conradson carbon residue of at least about 10 wt.%. Typically, less than 10 volume % of the heavy hydrocarbon feedstocks will have an initial boiling point of less than about 343° C. (650° F.).

The present selective separation is preferably effected by contacting the feedstock with a suitable adsorbent such as, e.g., clay, alumina, silica-alumina cracking catalyst, calcined bauxite, Fuller's earth, etc. having a major portion of its surface area in pores greater than about 50 Å in diameter. By major portion we mean that at least half of the surface area is in pores greater than about 50 Å, preferably at least 75% more preferably at least 90%, most preferably substantially all of the surface area is in pores greater than about 50 Å. Smaller pores permit the adsorption of only the smaller coke precursors and exclude most of the high molecular weight coke precursors from the surface area available in the small pores. Thus, separation with a typical small pore chromatographic adsorbent, such as silica gel and most commercially available aluminas, is poor compared with the large-pore adsorbents of the present invention. Any large-pore adsorbent selective for highly polar molecules can be used. Preferably, the adsorbent will be dry. The coke precursor depleted fraction and the coke precursor rich fraction can be recovered form the adsorbent by elution with one or more solvents having the appropriate solubility parameters.

Adsorbents having substantially no surface area in pores greater than 50 Å diameter are not capable of adsorbing relatively large polar molecules from heavy hydrocarbons, such as those feeds having a Conradson carbon residue of at least about 10 wt.%. Such adsorbents therefore have little effect on the coke precursor content of the treated oil. Consequently, uneconomically large amounts of such adsorbents would still be ineffective for reducing the coke precursor content of heavy oils. Adsorbents of the present invention, having essentially all of their surface area available in pores greater than about 50 Å in diameter can be used more economically owing to the higher allowable loadings of large polar molecules on the adsorbent. The adsorbent-to-oil ratio can then be derived from the amount of larger polar molecules in the feed and the amount of large-pore surface of the adsorbent. The ratio of adsorbent to polars in the feed, for purposes of the present invention, will be no greater than about 30 to 1.

The operating conditions employed can vary broadly depending upon the specific feedstock, the particular method employed to separate the polar/non-polar fractions and the like. The hydrocarbon feedstock should be liquid, and temperatures and pressures should be selected to ensure that the separation will occur in substantially the liquid phase. Broadly, the temperatures will range from about 0° to about 315.5° C. (600°), while operating pressures will normally range from about 0 to about 4.5 mPa (750 psig). The adsorption, the temperature will range between 0° and about 315.5° C. (600° F.) while pressure should be between 0 and 0.6 mPa (100 psig), preferably 0 and 0.3 mPa (50 psig). The contact time of the feedstock with the adsorbent will vary depending upon the polar content of the particular feedstock, but needs to be sufficient so that a major portion, preferably a substantial portion, of the coke precursors are adsorbed onto the adsorbent.

After the adsorption step the adsorbent containing a major portion of the coke precursors is contacted with at least one solvent having an overall Hildebrand solubility parameter of from about 8 to 9 and a complexing solubility parameter of 1.3 or less for a time sufficient to desorb the coke precursor depleted non-polar fraction, preferably 0.5 to 2 hours. After this period of time the adsorbent, with the depleted fraction desorbed therefrom, is contacted with at least one solvent with an overall Hildebrand solubility parameter from about 10 to where the solvent becomes immiscible with the coke precursor rich fraction, preferably from about 10 to 12 and a complexing solubility parameter greater than 1.3 for a time sufficient to desorb a coke precursor rich (polar) fraction which contains a major portion of the coke precursors present in the feedstock. The time period for this latter desorption step is preferably 1 to 2 hours.

In the desorption of the polar fraction, the Hildebrand solubility parameter of the solvent(s) is preferably sufficient to desorb the polar fraction but below the value at which the polar fraction will become insoluble in the solvent(s). Thus, preferably the Hildebrand solubility parameter of the solvent(s) employed the desorb the coke precursor rich (polar) fraction will range from about 10 to 12.

Examples of suitable solvents useful in desorption of the coke precursor depleted fraction include $C_{10}$ or greater aliphatic, or $C_6$ or greater alicyclic saturated hydrocarbons. Non-limiting examples include decane, cetane, cyclohexane, tetralin, decalin, toluene, xylenes, ethylbenzene, and mixtures thereof. It is noted, however, that if the feedstock contains asphaltenes the solvent is preferably not a paraffin. Preferably, this solvent is toluene or ethylbenzene. Examples of suitable solvents useful in desorption of the coke precursor rich fraction include phenol, m-cresol, tetrahydrofuran (THF) (with at least 5 wt.% or more water), a mixture of at least 10% by weight methanol in toluene, pyridine (with at least 5 wt.% water), etc. Preferred solvents in this latter category are mixtures of about 10% methanol in toluene, 5% water in THF, and 5% water in pyridine, with 5 wt.% in THF being most preferred.

As a result of the present separation technique, there is formed a coke precursor depleted (non-polar) fraction and a coke precursor rich (polar) fraction. The former fraction contains components of the hydrocarbon feedstock having an overall Hildebrand solubility parameter of 9.0 or less and a complexing solubility parameter of 1.3 or less. Since this fraction contains a reduced level of coke precursors, coke production will be minimized during subsequent thermal (or catalytic) processing.

The coke precursor rich (polar) fraction (which contains components of the feedstock having an overall Hildebrand solubility parameter of greater than 9.0 and a complexing solubility parameter of greater than 1.3) can be processed separately from the non-polar fraction. The solvent associated with each fraction from the particular separation process employed can be removed therefrom by conventional solvent removal techniques known in the art, e.g. distillation. The recovered polars fraction is then treated by any desired processing operation, preferably by a process other than catalytic cracking, such as hydroconversion.

Any suitable vessel can be used to practice the present invention. Depending on the particular method chosen, the vessel may be equipped with internal supports, baffles, trays and the like.

The present invention may be further understood by reference to the following examples, which are not intended to restrict the scope of the claims appended hereto. In the examples all parts and percentages are by weight and all temperatures are expressed in degrees Celsius, unless otherwise indicated.

EXAMPLE 1

A series of adsorption/elution runs on Cold Lake crude used as the hydrocarbon feedstock was made in a 2.54-cm diameter by 121.9-cm long packed column using three samples of Attapulgus clay increasing in water content and, thus, decreasing in adsorption strength. In each case the column was first filled from the bottom of cyclohexane to remove any air bubbles and to pre-wet the clay. The column was then loaded by preparing a solution of feedstock in cyclohexane and passing this solution into the top of the downflow-packed column. The loading of the feedstock on each sample of clay was about 6 wt.%. The clay had a surface area of about 108 square meters per gram of which about 82 square meters per gram were in pores greater than 50 Angstroms in diameter. Each sample was eluted successively with solvents of increasing polarity-cyclohexane, toluene and a mixture of 10 wt.% methanol in toluene to desorb the saturates, aromatics and polars, respectively. The solubility parameters of each solvent are shown in Table 11. The resulting yields are shown in Table 1 below:

TABLE 1

| | Yield, Wt. % on Cold Lake Crude | | |
|---|---|---|---|
| Solvent Eluted | Bureau of Standards Certified Clay | Dried Commercial Clay | Wet Commercial Clay |
| Cyclohexane Eluted (Saturates) | 32.0 | 44.0 | 59.1 |
| Toluene Eluted (Aromatics) | 19.7 | 18.3 | 16.6 |
| 10% $CH_3OH$/Toluene Eluted (Polars) | 48.3 | 37.7 | 24.3 |

Table I shows that the amount of Cold Lake crude strongly adsorbed by the clay (i.e., the polars) decreases as the adsorption strength of the clay decreases. Correspondingly, the cyclohexane eluted fraction increases and the intermediate toluene eluted fraction remains relatively constant. Thus with increasing wetness of the adsorbent, the separation is less selective. As such, it is preferred that the clay be dry.

The carbon residue of each fraction was then determined by thermogravimetric analysis (TGA), the results of which are shown in Table 2 below:

TABLE 2

| Solvent | Bureau of Standards Certified Clay | Dried Commercial Clay | Wet Commercial Clay |
|---|---|---|---|
| | TGA Carbon Residue, Wt. % | | |
| Cyclohexane Eluted | 0.0 | 0.0 | 0.2 |
| Toluene Eluted | 2.0 | 3.0 | 8.1 |
| 10% $CH_3OH$/Toluene Eluted | 16.9 | 21.6 | 27.5 |
| | % of Feed Total Carbon Residue | | |
| Cyclohexane Eluted | 0 | 0 | 1.3 |
| Toluene Eluted | 4.6 | 6.3 | 16.5 |
| 10% $CH_3$/ Toluene Eluted | 95.4 | 93.7 | 82.1 |

The data in Table 2 show that the carbon residue concentrates in the methanol/toluene eluted (polar) fraction in each clay sample. However, as the clay becomes increasingly wet, the carbon residue is reduced. In addition, the total feed carbon residue which appears in the polar fraction remains close to 95% until the adsorbent strength is greatly decreased.

EXAMPLE 2

Cold Lake crude was separated at room temperature in a 15.2-cm diameter and 121.9-cm long adsorbent bed by adsorption on commercially available chromatrographic alumina and successive elution with the three solvents of Example 1. The alumina had a surface area of about 282 square meters per gram of which about 19 square meters per gram were in pores greater than 50 Angstroms in diameter. The feed loading was 10 wt% on alumina, which overloaded the alumina and required rerunning the products at a lower loading (5 wt%) on a second batch of alumina to obtain good separation. Estimated product yields were 42 wt% eluted by cyclohexane ($CyC_6$), 31.0 wt% eluted by toluene and 26.8 wt% eluted by the methanol-toluene mixture. The compositions of the final product fractions are given in Table 3 below:

TABLE 3

| | CyC6 Eluted (Saturates) | Toluene Eluted (Aromatics) | Methanol/ Toluene (Polars) |
|---|---|---|---|
| Carbon Residue, Wt. % | 2.55 | 11.3 | 33 |
| Vanadium, wppm | 28 | 57 | 277 |
| Nickel, wppm | 10 | 21 | 67 |
| Nitrogen, Wt. % | 0.0456 | 0.19 | 1.11 |
| Sulfur, Wt. % | 2.36 | 6.06 | 6.04 |
| Conradson Carbon in Polars, % of Feed | — | — | 66 |

The data in Table 3 show that the major catalyst poisons for catalytic cracking (i.e., metal and nitrogen compounds) concentrate in the polar fraction and that the carbon residue, which along with metals is a poison for hydroconversion catalysts, also concentrates in the polars. As compared with Table 2, the data also show that clay is a preferred adsorbent to alumina because clay has a greater surface area in larger pores which facilitates a more selective separation of the coke precursors in the feedstock.

EXAMPLE 3

A comparison of the amount of distillate (atmospheric plus vacuum) which can be derived from heavy hydrocarbon feedstocks with the amount of non-polars obtainable using the dried commercial clay and solvents of Example 1 is shown in Table 4:

TABLE 4

| Yield, wt. % on Feed | Comparison Technique 555.6-°C. Distillate Fraction | Technique of Invention (Example 1) Non-Polar Fraction |
|---|---|---|
| Cold Lake Crude | 43 | 63 |
| Arabian Heavy Vacuum Resid | 0 | 49 |

The data in Table 4 show that a greater yield of useable hydrocarbons can be obtained from using the present invention relative to that obtained from distillation. This example also shows that the present invention enables the recovery of a substantial quantity of valuable hydrocarbons from a virtually undistillable feedstock.

EXAMPLE 4

A comparison was made among propane deasphalting, propane-N-methylpyrrolidone (NMP) double solvent extraction, and the selective separation over Attapulgus clay of Example 1 herein (using a 30.5 cm diameter adsorber), at the yield on Arab Heavy 510+° C. resid feedstock where 10% of the feedstock microcarbon residue (MCR) or 10% of the feedstock metals were contained in the nonpolar fraction. These yields of the nonpolar fraction are provided in Table 5.

TABLE 5

| Yield, Wt. % on Feedstock on Non-Polar Fraction | Propane Deasphalting Technique (Comparison) | Propane-NMP Technique (Comparison) | Technique of Invention (Example 1) |
|---|---|---|---|
| Microcarbon Residue | 30 | 27 | 45 |
| Metals | 58 | 45 | 63 |

The results show that at a level of 10% of the feed microcarbon residue or 10% of the feed metals in the refined non-polar fraction, the selective separation technique of this invention results in enhanced yields of residue and metals.

EXAMPLE 5

The saturate fraction and a blend of 80 wt.% saturates/20 wt% aromatics from Example 2 were cracked over a commercial zeolite fluid cracking catalyst (CBZ-1) in a laboratory reactor at 500° C., 0.009 mPa and at 11.0 weight space velocity to determine the cracking response of each fraction compared to that of a 343.3/537.8° C. vacuum gas oil (VGO) from Cold Lake crude. The results from this experiment are provided in Table 6 below.

TABLE 6

| Wt. % Based on Feed | 343/538° C. Cold Lake VGO | Fractions from Example 2 | |
|---|---|---|---|
| | | Saturates | Saturates/ Aromatics Blend |
| Conversion | 48 | 72.2 | 70.8 |

TABLE 6-continued

| Wt. % Based on Feed | 343/538° C. Cold Lake VGO | Fractions from Example 2 Saturates | Saturates/ Aromatics Blend |
|---|---|---|---|
| Naphtha | 41 | 55.8 | 51.2 |
| $C_1$-$C_3$ Hydrocarbon Gas | 4.0 | 5.9 | 5.4 |

The data in Table 6 show that the fractions from Example 2 are better cracking feedstocks than vacuum distillate from the same crude source, i.e., higher conversion and better yields are obtained treating resid non-polar fractions obtained using the present invention relative to the conversion and yields obtained from treating conventional vacuum gas oil.

EXAMPLE 6

Two laboratory separations of Cold Lake Crude were made using the technique described in Example 2. The alumina of Example 2 was used as the adsorbent in one separation and the dried commercial clay of Example 1 as the adsorbent in the other separation. In both separations, the feed loading on the column was maintained below the loading limit required to maintain good chromatographic separations. The yields of the fractions eluted by the solvents of Example 1 are given in Table 7 below:

TABLE 7

| | Alumina | Clay |
|---|---|---|
| Loading, wt. % on Adsorbent | 4.3 | 6.3 |
| Cyclohexane Eluted (Saturates), wt. % | 25.4 | 44.3 |
| Toluene ELuted (Aromatics), wt. % | 37.8 | 19.0 |
| 10% $CH_3OH$/Toluene Eluted (Polars, wt. %) | 36.8 | 36.6 |
| Conradson Carbon in Polars, k % of Total in Feed | 80 | 81 |

The data in Table 7 show that the yield of polars for each adsorbent is essentially the same and that alumina retains the single ring aromatics better than clay; i.e., an increased yield of saturates is obtained using clay as an adsorbent. An analysis of each fraction also confirmed that the impurities which contribute to catalyst poisoning and deactivation concentrate in the polars. In addition, this example shows that about the same concentration of coke precursors in the polars can be obtained with both adsorbents provided the feed loading on the alumina is reduced until the surface are in pores having a diameter greater than 50 Angstroms is adequate.

EXAMPLE 7

Adsorption separations were performed on vacuum distillates from Cold Lake and Arabian Heavy Crudes using the alumina of Example 2. Each distillate was dissolved with n-heptane and then contacted with an amount of alumina such that the loading of the resid thereon would be between 0.4 and 1.1 wt.%. Normal heptane was used to dissolve each distillate since no asphaltenes were present and, hence, would not be precipitated. The polars and aromatics of each distillate were adsorbed into the alumina while the saturates remained dissolved in the n-heptane. The polars were then separated from the aromatics by toluene elution and were recovered from the adsorbent by elution with acetone (which has a Hildebrand solubility parameter of 9.6 and a complexing solubility parameter of 6.25). The results from this experiment are shown in Table 8 below.

TABLE 8

| Distillate Cut | % Polars in Distillate | Carbon Residue, Wt. % Polars | Non-Polars |
|---|---|---|---|
| Cold Lake 537.8-565.6° C. | 8.5 | 7.6 | 0.7 |
| Arabian Heavy 537.8-551.7° C. | 6.6 | 20.3 | 3.6 |

The data in Table 8 show that for heavy vaccum distillate, coke precursors also accumulate in the polar fraction.

EXAMPLE 8

Batch and column adsorption separations of Arabian Heavy 510+° C. vacuum residuum over the dried commercial Attapulgus clay of Example 1 were performed at room temperature. In the batch separation, the amount of resid required to give 5 wt.% loading on the clay was dissolved with cyclohexane. Clay was then added and the slurry was stirred for several hours. Cyclohexane was removed by vacuum distillation to yield a clay having 5 wt.% loading of the resid. The clay was stirred for 16 hours at room temperature with cyclohexane. The clay was then removed by filtration and contacted for another 16 hours with toluene. This procedure was repeated using the methanol-toluene mixture.

An adsorption separation was also made using a packed column with 5 wt.% loading of feed on the clay. The results from both separations are shown in Table 9 below:

TABLE 9

| | Batch | Column |
|---|---|---|
| Cyclohexane Eluted | | |
| Yield, wt. % | 38.5 | 20.8 |
| Conradson Carbon, wt. % | 2.2 | 0.3 |
| Nitrogen, wt. % | 0.02 | 0.001 |
| Nickel, wppm | 5.0 | 3.3 |
| Vanadium, wppm | 2.0 | 0.9 |
| Toluene Eluted | | |
| Yield, wt. % | 26.1 | 24.8 |
| Conradson Carbon, wt. % | 17.9 | 12.3 |
| Nitrogen, wt. % | 0.26 | 0.11 |
| Nickel, wppm | 8 | 11 |
| Vanadium, wppm | 9.8 | 3.2 |
| 10% $CH_3OH$/Toluene Eluted | | |
| Yield, wt. % | 35.4 | 54.4 |
| Conradson Carbon, wt. % | 33.8 | 32.5 |
| Nitrogen, wt. % | 0.9 | 0.7 |
| Nickel, wppm | 64 | 56 |
| Vanadium, wppm | 307 | 238 |
| Conradson Carbon in Polars, % of Feed | 69 | 85 |

The data in Table 9 show that batch operations are not as effective in segregating coke precursors as are operations using a column since the former is equivalent to but one theoretical plate. This example also supports a conclusion of Example 3—that valuable non-polars can be obtained from an essentially undistillable feed by use of the present invention.

EXAMPLE 9

Samples of resid feed, asphalt, and deasphalted oil were obtained from a commerical propane deasphalter. The feedstock was predominantly Arabian Light vacuum residuum. Each fraction was then separated chromatographically using the alumina of Example 2 and the solvents of Example 1 to give the results shown in Table 10 below.

TABLE 10

| | Composition of Fractions, Wt. % of Deasphalter Feed | | |
|---|---|---|---|
| | Saturates | Aromatics | Polars |
| Feed | 62 | 27 | 11 |
| Deasphalted Oil | 49 | 4 | 1 |
| Asphalt | 13 | 23 | 10 |

The data in Table 10 show that while almost 90% of the polars are concentrated in the asphalt, 36 wt.% (on feed) of the non-polars is also rejected into the asphalt—so much, in fact, that the asphalt is predominantly non-polars.

EXAMPLE 10

An adsorption separation over the dried commercial Attapulgus clay of Example 1 was performed on Cold Lake crude and on a n-heptane deasphalted oil (DAO) fraction derived from the same crude. Asphaltene removal was done at room temperature using 10 weights of n-heptane per weight of crude. The asphaltene precipitate was removed by filtration. Normal heptane was removed from the filtrate by vacuum distillation. Solvents of increasing solubility parameter was used successively to elute fractions of increasing polarity from each feedstock. The results are shown in Table 11 below:

TABLE 11

| Eluting Solvent | Cumulative Eluted Yield, wt. % | | Hildebrand Solubility Parameter of Solvent | Complexing Solubility Parameter of Solvent | Carbon Residue, wt. % Non-Cumulative | | Carbon Residue, wt. % Cumulative | |
|---|---|---|---|---|---|---|---|---|
| | Crude | DAO | | | Crude | DAO | Crude | DAO |
| Cyclohexane (saturates) | 36.6 | 55.9 | 8.19 | 0.00 | 0.2 | 0.8 | 0.2 | 0.8 |
| 5 wt. % Toluene in Cyclohexane | 45.7 | — | 8.23 | 0.07 | 1.2 | — | 0.4 | — |
| 10 wt. % Toluene in Cyclohexane | 48.6 | — | 8.26 | 0.1 | 4.2 | — | 0.63 | — |
| 25 wt. % Toluene in Cyclohexane | 52.2 | — | 8.38 | 0.3 | 9.5 | — | 1.25 | — |
| 50 wt. % Toluene in Cyclohexane | 53.8 | — | 8.56 | 0.7 | 14.6 | — | 1.64 | — |
| 100 wt. % Toluene (total non-polars) | 55.3 | 71.2 | 8.93 | 1.3 | 18.2 | 8.2 | 2.1 | 1.9 |
| Methylethylketone | 77.4 | — | 9.45 | 5.5 | 24.5 | — | 8.5 | — |
| Tetrahydrofuran | 83.5 | — | 9.52 | 4.8 | 38.2 | — | 10.6 | — |
| 10 wt. % methanol in Toluene | — | 100.0 | 9.49 | 2.6 | — | 23.4 | — | 8.7 |
| 5 wt. % $H_2O$ in THF | 100.0 | — | 10.21 | 5.6 | 33.0 | — | 14.7 | — |
| Total Polars, wt. % | 44.7 | 28.8 | — | — | | | | |

The data in Table 11 show that a substantial portion of the carbon residue (i.e., coke precursors) is concentrated in that portion of the feedstock which has an overall Hildebrand solubility parameter greater than 9.0 and a complexing solubility parameter greater than 1.3. Also the deasphalted oil data show that even though the n-heptane asphaltenes have been removed and the yield of non-polars is about 71 wt.%, the selectivity of deasphalting for coke precursors is poor since about 29 wt.% polars remain in the DAO.

EXAMPLE 11

A 500 cc adsorption column was filled with about 210 grams of Bureau of Standards certified Attapulgus Clay of Example 1 that had been vacuum dried at 110° C. before charging. Shale oil was loaded on the clay column as a 20% solution in cyclohexane after the column was pre-wet with cyclohexane passing up-flow to remove air bubbles. The shale oil loading of the column was 11.1 wt.% on clay. After column loading was complete, the solvents of Example 1 were used in succession, changing solvents only after no more shale oil was being desorbed, i.e., less than 0.01 percent shale oil was in the exiting solvent. The shale oil was recovered by removing the solvent by fractional distillation. The results of this experiment are shown in Tables 12 and 13 below:

TABLE 12

| Elution Solvent | Recovery, wt. % on Feed |
|---|---|
| Cyclohexane | 51.2 |
| Toluene | 21.8 |
| 10% Methanol in Toluene | 27.2 |
| | TGA Carbon Residue of Fractions, wt. % |
| Cyclohexane | 0.02 |
| Toluene | 3.3 |
| 10% $CH_3/OH$ Toluene | 13.4 |
| Conradson Carbon in Polars, % of feed | 83.3 |

TABLE 13

| | Feed | Cyclohexane | Toluene | 10% $CH_3OH$/Toluene |
|---|---|---|---|---|
| Yield, g. | 23.29 | 11.93 | 5.07 | 6.33 |
| Inspections | | | | |
| Nitrogen, wt. % | 2.59 | 0.61 | 2.27 | 4.03 |
| Sulfur, wt. % | 0.92 | 0.63 (0.93) [b] | 0.41 | 1.01 |
| Oxygen, wt. % | 1.34 | 0.40 | 1.27 | 3.68 |
| Vanadium, wppm | 1 | 0.36 | 0. | 5.6 |
| Nickel, wppm | 4 | 0.15 | 25. | 31.9 |
| Carbon residue, wt. %[a] | 2.8 | 0.0 | 3.8 | 13.4 |

[a]By thermogravimetric analysis at 800° C.
[b]Repeat analysis.

This example shows that the impurities and coke precursors concentrate in the polar fraction derived from shale oil just as in the polar fraction derived from petroleum sources such as is shown in Example 1.

EXAMPLE 12

An adsorption column was filled with about 292 grams of the chromatographic alumina used in Example 2. A sample of 59.4 grams of coal pyrolysis liquid was added to the top of the column and successively eluted with the solvents of Example 1. Because coal liquids may contain components or molecules of greater polarity than petroleum and shale oil liquids, additional eluting solvents (pyridine and a mixture of 5 wt.% water in THF) were used following the methanol/toluene mixture. The results of this experiment are shown in Table 14 below:

TABLE 14

| | Feed | Cyclohexane | Toluene | 10% MeOH/ THF | 5% $H_2O$/ Pyridine | |
|---|---|---|---|---|---|---|
| Sample Weight, g. | 59.4 | 24.97 | 10.49 | 12.33 | 1.43 | 0.07 |
| Recovery, Wt. % (Output) | 83.0[a] | 50.7 | 21.3 | 25.0 | 2.9 | 0.1 |
| Inspections | | | | | | |
| Nitrogen, wt. % | 0.79 | 0.3 | 1.49 | 1.72 | 0.83 | — |
| Sulfur, wt. % | 0.12 | 0.2 | 0.22 | 0.30 | 0.26 | — |
| Oxygen, wt. % | 5.80 | 1.6 | 3.63 | 10.9 | | — |
| Vanadium, wppm | 0.19 | 0.2 | 0.11 | 0.57 | | — |
| Nickel, wppm | 2.09 | 0.99 | 1.48 | 3.34 | | — |
| TGA Carbon Residue, wt. %[b] | 2.9 | 0.65 | 5.7 | 14.8 | 26.0 | — |
| Conradson Carbon, Wt. % | 8.26 | 1.0 | 0.2 | 23.3 | 33.7 | — |
| Feed Conradson Carbon in Polars, % | — | — | — | — | 71.9 | — |

[a]Total recovery based on feed. Loss is probably light ends removed during solvent removal.
[b]TGA residue at 800° C.

The results of this experiment show that with coal liquefaction products, the impurities and coke precursors also concentrate in the polar fraction. Since the coal hydropyrolysis liquid is essentially all distillate, a comparable boiling range cut from petroleum would be completely eluted with 10% methanol in toluene. The extra 3% removed by 5% $H_2O$ in THF and pyridine shows that the coal liquid contains some components of higher polarity relative to a comparable boiling range petroleum fraction.

EXAMPLE 13

This example illustrates measurement of the different polarities of the saturates, aromatics and polar fractions as determined from their dielectric properties.

Using the adsorption technique of Example 1, with a greater variety of solvents, six fractions (one saturates fraction, two aromatics and three polars fractions) were obtained which were analyzed for their dielectric properties. These fractions, contained in various solvents indicated in Table 15, were dissolved in 1-methylnaphthalene to form 20% solutions, which were then evaluated using time domain spectrometry. Table 15 provides the static dielectric constants $\xi o$, and the maximum value of dielectric loss, $\xi''m$.

TABLE 15

| Fraction | Solvent System | $\xi o$ | $\xi''m \times 102$ |
|---|---|---|---|
| Saturates | — | 2.753 ± 0.007 | 1.0 ± 0.1 |
| Aromatics | 5% Toluene 95% cyclohexane | 2.828 ± 0.005 | 2.4 ± 0.4 |
| | 100% toluene | 2.874 ± 0.007 | 3.5 ± 0.4 |
| Polar | 100% methyl-ethylketone | 3.040 ± 0.03 | 10.1 ± 1.4 |
| | 100% Tetra-hydrofuran THF - $H_2O$ | 3.000 ± 0.020 | 7.4 ± 1.6 |

The time-dependent spectroscopy data in Table 15 shows that the saturates, aromatics and polars fractions have distinctive dielectric constants, and thus distinct polarities. The saturates had the lowest dielectric constant, and thus the lowest polarity. The two aromatic fractions showed a solvent polarity effect in that the 100% toluene cut had a higher dielectric constant and dielectric loss than did the cut with a mixture of toluene and cyclohexane, indicating that the former extracted more polar aromatics.

In summary, the present invention is seen to provide a process for selectively removing a major portion of the coke precursors (carbon residue) from a hydrocarbon feedstock in which a coke precursor depleted (non-polar) fraction is separated from a coke precursor rich (polar) fraction defined by containing a major portion of feedstock components with minimum solubility parameters.

EXAMPLE 14

In order to gain a better understanding of the adsorption of the most polar component of heavy crudes, normal heptane asphaltenes, precipitated from Cold Lake crude with 10 volumes of n-heptane, were separated chromatographically over Attapulgus clay and commercially available chromatographic alumina having a surface area of about 282 $m^2/g$ of which about 19 $m^2/g$ were in pores greater than 50 Angstroms in diameter. The yields of the fractions are given in the table below along with the molecular weights of the adsorbed fractions.

TABLE 16

| | Absorbent | |
|---|---|---|
| | Attapulgus Clay | Alumina |
| Feed Loading, wt. % on Adsorbent | 2.9 | 10.0 |
| Polar Fraction Loading, Wt. % on Adsorbent | 2.9 | 2.2 |
| Yields, Wt. % | | |
| Cyclohexane Eluted | 0.85 | 77.7 |
| Toluene Eluted | | |
| 10% $CH_3OH$/Toluene Eluted | 70.7 | 21.9 |
| Pyridine Eluted | 7.2 | — |
| Molecular Weights, VPO | | |
| Aromatics | — | 9,807 |
| Polars | 3,310 | 1,786 |
| Number Average Molecular Weights, GPC | | |
| Aromatics | — | 1,956 |
| Polars | 1,988 | 817 |
| ratio of polars in wt. % having molecular weight >1,000 to adsorbent having majority of pores >50Å | 1:35 | 1:46 |

These data show that the clay adsorbs asphaltenes much more effectively than alumina, and that the alumina is highly overloaded even though it has retained only 2.2% on adsorbent of polars compared to 2.9% for the clay. This is because the clay has much larger pores than the alumina and allows more of the large asphaltene molecules to adsorb. The molecular weight data show that the polar molecules desorbed from alumina are much smaller than those desorbed from the clay as would be expected from pore size effects.

The clay data show that n-heptane asphaltenes are most exclusively polar aromatics of high molecular weight.

EXAMPLE 15

A series of batch adsorption runs were made with Attapulgus clay and neutral Alfa alumina to determine the effect of oil-to-adsorbent ratio on carbon precursor removal. Cold Lake crude oil was batch adsorbed overnight into 100 g. of adsorbent from a solution of the calculated amount (5 to 200 g.) of feedstock in three liters of cyclohexane. After the overnight contacting the adsorbent was filtered from the slurry and the unadsorbed oil was recovered by evaporation of the cyclohexane solvent. The "saturate" yields, i.e. the unadsorbed material remaining in the cyclohexane, and the microcarbon residues of these "saturate" fractions were determined and related to adsorbent loading. From the data in Table 17 below, it is clear that the clay has significantly higher adsorption capacity for the coke precursors than the alumina and more selectively adsorbs the microcarbon precursors. As loading of oil on the adsorbent is increased, the microcarbon residue of the alumina-treated oil increases four times as fast as that for the clay-treated oil. Furthermore, the amount of oil that can be treated with clay to get complete removal of coke precursors is almost double that for the Alfa alumina.

TABLE 17

| | Attapulgus Clay | Neutral Alfa Alumina |
|---|---|---|
| Capacity at Trace Microcarbon, g/g adsorbent | 0.08 | 0.05 |
| Polar Molecule Loading, g/g Adsorbent | 0.032 | 0.020 |
| Adsorbent Surface Area, $M^2/g$ | | |
| Total | 108 | 250 |
| >50Å | 82 | 57 |
| Polar Molecule Loading | | |
| Grams/$M^2$ > 50Å | 0.00038 | 0.00035 |
| Ratio of polars by wt. % having a molecular wt. >1,000 to adsorbent having majority of pores >50Å | 1:35 | 1:46 |

However, when calculated on the basis of surface area in pores greater than 50 Å diameter, both adsorbents can adsorb 0.00036±0.0002 g. of polar molecules per square meter of such surface. Because Alfa alumina is unusual in having such a large surface area in large pores (still only 20% of its total surface, other aluminas (MCB=19 $m^2$g. of large pores) will have much lower capacities for adsorption of large polar microcarbon precursors. The capacity of an adsorbent for removal of microcarbon precursors can thus be calculated from the content of large polar molecules in the feed oil and the surface area in pores greater than 50 Å diameter for the adsorbent.

What is claimed is:

1. A process for selectively removing a major portion of the coke precursors from atmospheric and vacuum residuum having a Conradson carbon residue of at least about 10 wt.% which process comprises:

(a) contacting said resid with an adsorbent which has a major portion of its surface area in pores greater than 50 Angstroms in diameter and in an amount such that the ratio of adsorbent to polars in the feed is no greater than 30 to 1, for a period of time sufficient to adsorb a major portion of said coke precursors onto said adsorbent, (b) contacting the adsorbent resulting from step (a) with at least one solvent having an overall Hildebrand solubility parameter from about 8 to 9 and a complexing solubility parameter of 1.3 or less for a period of time sufficient to desorb a coke presursor depleted fraction, and (c) contacting the adsorbent resulting from step (b) with at least one solvent having an overall Hildebrand solubility parameter from about 10 to about the value wherein the solvent is immiscible with the resulting coke precursor rich fraction and a complexing solubility parameter greater than 1.3% for a period of time sufficient to desorb a coke precursor rich fraction which contains a major portion of the coke precursors present in said resid.

2. The process of claim 1 wherein said adsorbent is selected from the group consisting of clay and alumina.

3. The process of claim 1 wherein less than 10 volume % of said feedstock has an initial boiling point of less than about 343° C.

4. The process of claim 1 wherein said resid is a vacuum resid.

5. The process of claim 1 wherein a substantial portion of all the coke precursors present in said resid are removed therefrom.

6. The process of claim 1 wherein solvent is recovered from the coke precursor depleted fraction and the coke precursor rich fraction.

7. The process of claim 1 wherein an enhanced yield of the coke precursor depleted fraction is recovered relative to the yield obtained in the absence of separating said resid into said coke precursor depleted fraction and said coke precursor rich fraction.

8. The process of claim 2 wherein the overall Hildebrand solubility parameter of the solvent of step (c) ranges from greater than 10 to 12.

9. The process of claim 2 wherein the solvent of step (b) is cyclohexane.

10. The process of claim 2 wherein the solvent of step (b) is cyclohexane.

11. The process of claim 2 wherein the solvent in step (c) is a mixture of about 5% water in THF.

* * * * *